US006343892B1

(12) United States Patent
Kristiansen

(10) Patent No.: US 6,343,892 B1
(45) Date of Patent: Feb. 5, 2002

(54) DRILLING TOWER

(76) Inventor: Gunnar Kristiansen, c/o Kongshavn Industri, N-5076 Alvoen (NO)

( * ) Notice: Subject to any disclaimer, the term of this patent is extended or adjusted under 35 U.S.C. 154(b) by 0 days.

(21) Appl. No.: 09/622,801

(22) PCT Filed: Feb. 24, 1998

(86) PCT No.: PCT/NO98/00053

§ 371 Date: Oct. 4, 2000

§ 102(e) Date: Oct. 4, 2000

(87) PCT Pub. No.: WO99/43920

PCT Pub. Date: Sep. 2, 1999

(51) Int. Cl.[7] ..... E21B 15/00

(52) U.S. Cl. ..... 405/195.1; 175/203; 175/162; 187/272; 187/274; 414/22.51; 414/22.63

(58) Field of Search ..... 175/162, 203; 187/272, 274, 275, 215, 229; 405/195.1, 196, 201, 224.2, 224; 414/22.57, 22.63, 22.64, 22.67, 22.68, 22.69, 22.77, 22.55

(56) References Cited

U.S. PATENT DOCUMENTS 3,949,818 A * 4/1976 Russell ..... 175/52
3,949,883 A * 4/1976 Crooke et al. ..... 414/22.63
4,027,854 A * 6/1977 Mounton, Jr. ..... 254/29 R
4,170,340 A * 10/1979 Mouton, Jr. ..... 254/29 R
4,238,911 A 12/1980 Mazur
4,251,176 A 2/1981 Sizer et al.
4,341,373 A 7/1982 Mouton, Jr.
4,357,994 A 11/1982 Hall
4,585,213 A * 4/1986 Slagle, Jr. et al. ..... 254/388
4,629,014 A * 12/1986 Swisher et al. ..... 175/162
4,858,694 A * 8/1989 Johnson et al. ..... 175/5

FOREIGN PATENT DOCUMENTS

NO 159303 12/1988
NO PCT/NO98/00053 2/1998

* cited by examiner

*Primary Examiner*—David Bagnell
*Assistant Examiner*—Frederick L. Lagman
(74) *Attorney, Agent, or Firm*—Shanks & Herbert

(57) ABSTRACT

A derrick comprises equipment (41) for movement of a pipe line/drill stem (13) or a pipe section (29) axially in the derrick (12), and equipment (65) for turning of same about its longitudinal axis, together with equipment (31) for installing pipe sections (29) in the derrick (12) and withdrawal of pipe sections (29) from the derrick (12). The equipment comprises an aggregate (41) of axially extendible/contractible hydraulic cylinders (42*a*–42*c*, 43*a*–43*c*, which are arranged in groups (42, 43, 44) in the aggregate (41) in two or more vertical rows, with an intermediate vertical guide for the pipe line/drill stem (13) or for the pipe section (29). The rows of cylinders are mutually rigidly connected via bridge portions (45', 45", 45'''), which separately form a fastening for at least one end of a group of cylinders. Each bridge portion is provided with a laterally opening recess (46) for sideways installation/withdrawal of a pipe section (29) in the guide between the rows of cylinders.

7 Claims, 9 Drawing Sheets

DRILLING TOWER

The present invention relates to a derrick, comprising a number of hydraulic cylinders arranged in groups having pistons and associated extendible piston rods for axial movement of a drill stem in the derrick, where the piston rods are mutually rigidly connected to each other at their upper ends with a bridge portion.

The present invention is particularly designed for use in drilling operations at sea, but will also be able to find application in drilling operations on land. The aim is the application of the derrick in connection with inter alia hydraulic well overhauling, so-called "slime hole drilling", drilling of multilateral completion drilling of side rungs, and the like.

During the guiding down of the pipe line/drill stem in a well hole, during the drilling operation and on maintenance of a well hole ("work-over") or in other current operations, it is usual to join together one after the other a series of following pipe sections in the derrick in extension of the pipe line/drill stem and to dismantle in the derrick one after the other a series of pipe sections from the pipe line/drill stem. The joining together takes place by installing the pipe sections individually one after the other in the derrick and that the lower end of the pipe section is joined together with the pipe line/drill stem by turning the pipe section relative to the pipe line/drill stem. The joining together occurs via equivalent thread portions in two mutually abutting pipe sections, and the joining together is followed by a guiding down of the joined pipe line/drill stem towards the bottom of the well hole.

Correspondingly on bringing up of the pipe line/drill stem from the well hole it is usual to dismantle the pipe line/drill stem in the opposite consecutive order by withdrawal of the pipe sections individually, one after the other, after a preceding stepwise hoisting of the pipe line/drill stem.

Generally the hoisting has hitherto taken place with a relatively complicated hoisting device comprising a winch with several parallel hoisting portions. The known hoisting device has a tendency to increase to an unnecessary degree the working time for each operation of joining together and thereby correspondingly reduces the working capacity and increases costs. In certain phases of leading down this can occur by means of the weight of the pipe line/drill stem. In the remaining phases of the guiding down of the pipe line/drill stem there is a need for an extra pushing force on the pipe line/drill stem in addition to the weight of the pipe line/drill stem. This creates extra complications on existing procedures of guiding down pipes. In addition extra equipment is required for controlling the guiding down with a pushing force.

In each drilling operation and each bringing up of the pipe line/drill stem from the oil well and subsequent guiding down of the same towards the well, there is a question about separately handling a large number of pipe sections individually. The time which is involved for each pipe section in the down-guiding operation and the operations of joining together and in the bringing-up operation and the operations of dismantling are of great significance for the collective working capacity and the costs following from this. With the present invention the aim is a solution, which can reduce the working time and thereby increase the working capacity, particularly in connection with the operations of joining together and the dismantling operations, but in addition also in the bringing up and guiding down of the pipe line/drill stem.

The movement of a pipe line/drill stem and a pipe section in an axial direction in the drill rig has, as mentioned above, hitherto proceeded by means of a winch with associated hoisting line portions. In an introductory phase of the guiding down of the pipe line/drill stem it is customary to exert an axial pressure ("snubbing") against the pipe line/drill stem via extra equipment which can exert pushing forces in the pipe line/drill stem in addition to the weight loading in the same, while in a later phase of the guiding down it is customary to relieve the weight of the pipe line/drill stem via the hoisting winch.

With the present invention a particular aim in connection with the afore-mentioned, is to combine the bringing-up and guiding-down operations into one and the same means, that is to say to replace the hoisting devices (winch and hoisting line portions) and the equipment producing said extra pushing force by one and the same means.

The derrick according to the invention is characterized in that the derrick, in addition to the first mentioned group of hydraulic cylinders, comprises additionally, groups of hydraulic cylinders arranged above each other with respective piston rods connected in upper bridge portions, each group of above-standing cylinders being carried by the bridge portion of the group standing below, that each group of cylinders in arranged around a central space for the drill stem, and the derrick carries arrangements for rotation of the drill stem, said arrangements being releasably fixed to the bridge portion for the uppermost group of pistons.

By combining, according to the invention, the hoisting operations and the guiding-down operations (with and without pushing force) in one and the same group of hydraulic cylinders, several significant advantages are achieved, both constructionally and operatively. Consequently by the aforementioned solution fundamental advantages can be achieved of a working as well an economic kind.

By employing, according to the invention, groups of hydraulic driven pressure medium cylinders arranged vertically above each other, the single pipe section can be moved in an intended stepwise manner or in a more or less continuous manner in opposite directions according to need in the derrick, independently of what forces which are to be transferred to the pipe line/drill stem. The movements can be carried out according to the invention during the exercise of greater or smaller tractive forces or pushing forces, as required, with one and the same equipment.

By employing a number of cooperating hydraulic cylinders placed in groups above each other in the derrick, the collective power transmission of several hydraulic cylinders can be distributed in each height level of actual interest in the derrick and the collective length of movement distributed correspondingly of several hydraulic cylinders following axially in the height of the derrick.

Consequently the axial movements of pipe sections or pipe line/drill stem in the derrick can be carried out in an especially controlled and reliable manner and yet with a relatively high speed. With the derrick according to the invention movements over relatively large heights can consequently be effected in the derrick with regulatable stages of movement and lengths of movement and with regulatable speeds of movement and regulatable actuation forces, as required.

By arranging the hydraulic cylinders, according to the invention, in two or more vertical rows there can be arranged a guiding of the pipe section centrally between the rows and provided at the same time a favorable constructional mutual reinforcing and shoring up of the hydraulic cylinders relative to the pipe line/drill stem.

By connecting the groups of hydraulic cylinders according to the invention in rigid connection with each other, that is to say with a mutually reinforcing connection, by means of associated rigid bridge portions at different height levels in the derrick, it is possible to subject the drill stem/pipe line or the pipe section to lifting or lowering movements in a favorable manner with sufficient safety and stability.

There is preferred in practice a particular constructional arrangement of the rows of power means. In this connection the arrangement according to the invention is characterized in that the cylinders in each group are mounted in the form of a triangle equally spaced relative to each other.

Further for constructional and reinforcing reasons it is preferred that the cylinders in the uppermost group have the least mutual spacing, and the cylinders in the lowermost group have the greatest mutual spacing.

Further for constructional and reinforcing reasons it is preferred that each bridge portion is supported and reinforced via guide rails in the derrick per se and via control means, such as steering rollers, in the bridge portion.

In practice provision is made for the bridge portion or each bridge portion, in addition to the fastening for the one end of the piston rods of the cylinders of the associated group, to form a fastening for cylinders of an above group or form a guide for piston rods of an additional group which pass through the bridge portion.

The derrick according to the invention is further characterized in that each bridge portion is provided with a laterally opening passage for sideways installation and sideways removal of a pipe section of the drill stem in the space between the group of cylinders, and that the recess is closeable with stop means for shutting off a section of the drill stem with side support in a guide in the recess.

The derrick according to the invention is further characterized in that the arrangements for rotation of the drill stem are arranged in a separate carriage, which is designed for separate handling of a drill stem section relative to the remaining drill stem, the carriage in a first position being releasably fixable to the bridge portion for an uppermost group of cylinders' piston rods, while the carriage in a second position is separately parkable at a distance from said bridge portion.

Further features of the invention will be evident from the following description having regard to the accompanying drawings, in which.

Figure 1:
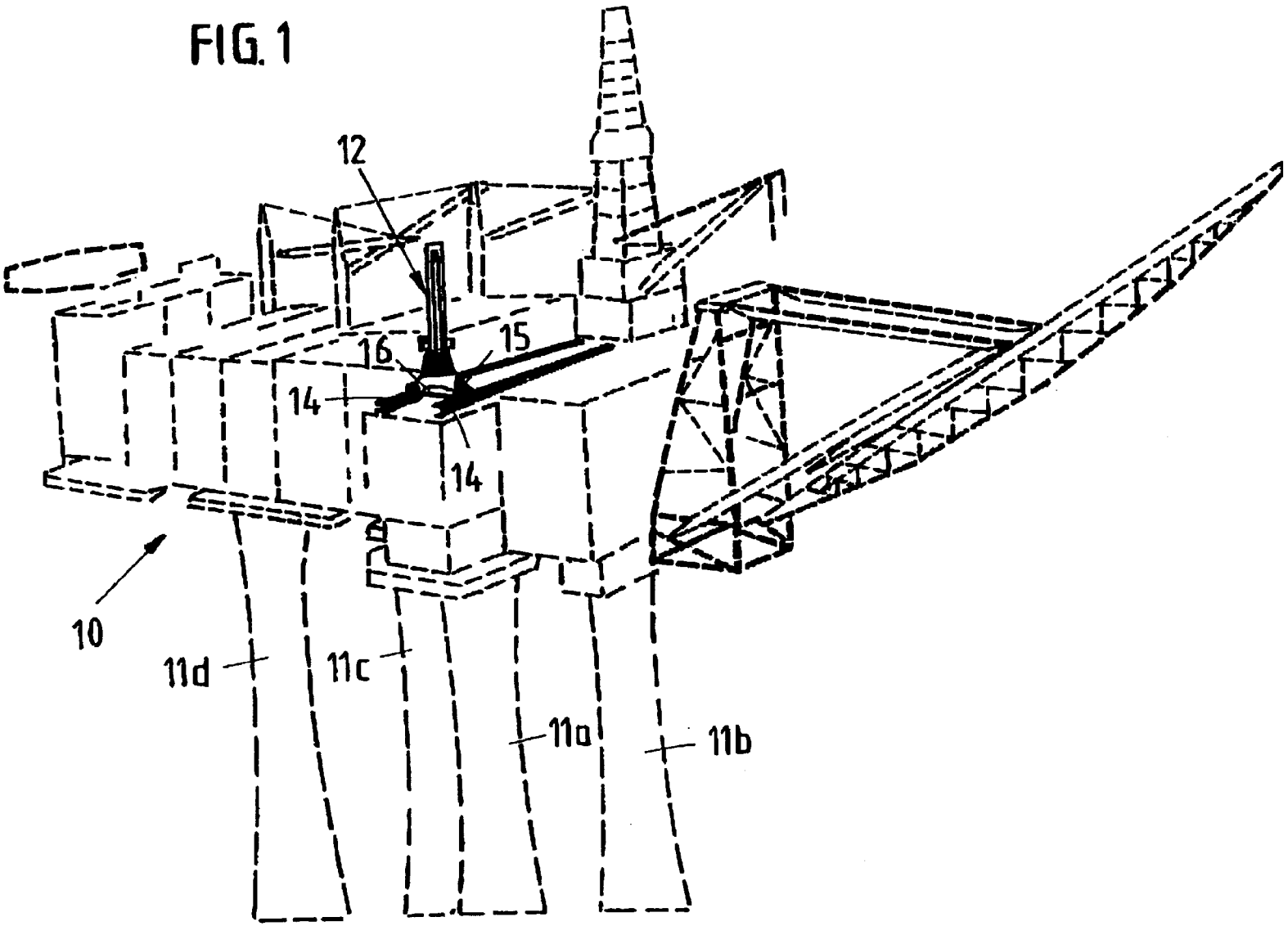
FIG. 1 shows schematically in perspective an actual placing of a derrickon an oil platform.

In FIG. 1 there is shown an oil platform 10 which is carried on the sea bottom (not shown further) via column legs 11*a*–11*d*. Vertically above the one column leg 11*a* there is arranged a derrick 12. A pipe line/drill stem 13 (see FIG. 4–7), which is operated via the derrick 12, extends from the derrick 12 via the column leg 11*a* downwards through a bore hole in an underlying ground formation down towards the bottom of an oil well, in a manner not shown further. The bore hole is formed by current techniques often by way of introduction with a vertical path, which is followed by a deflected path in a horizontal direction, possibly an obliquely downwardly directed path and/or an obliquely upwardly directed path.

The derrick 12 is supported on the platform 10 on a pair of longitudinal, mutual parallel carrier rails via a pair of intermediate, transverse, mutually parallel carrier rails 15, which are rigidly connected to the carrier rails 14. There is defined an intermediate,,central opening 16 for guiding through the pipe line/drill stem 13 from the derrick 12 downwards in the column leg 11*a*.

Figure 2:
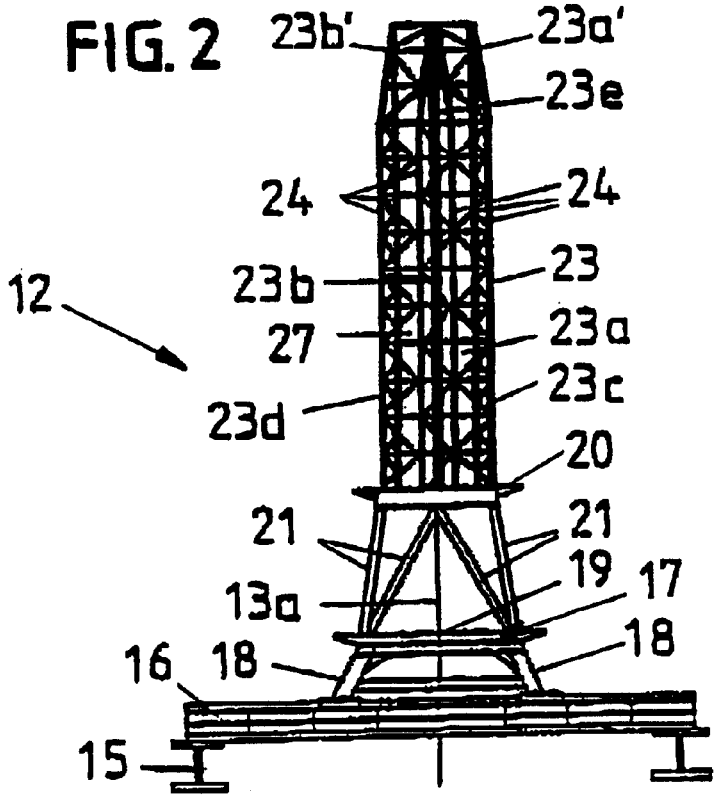
FIGS. 2 and 3 show schematically a part of a derrick illustrated in front sketch and side sketch respectively.
Figure 3:
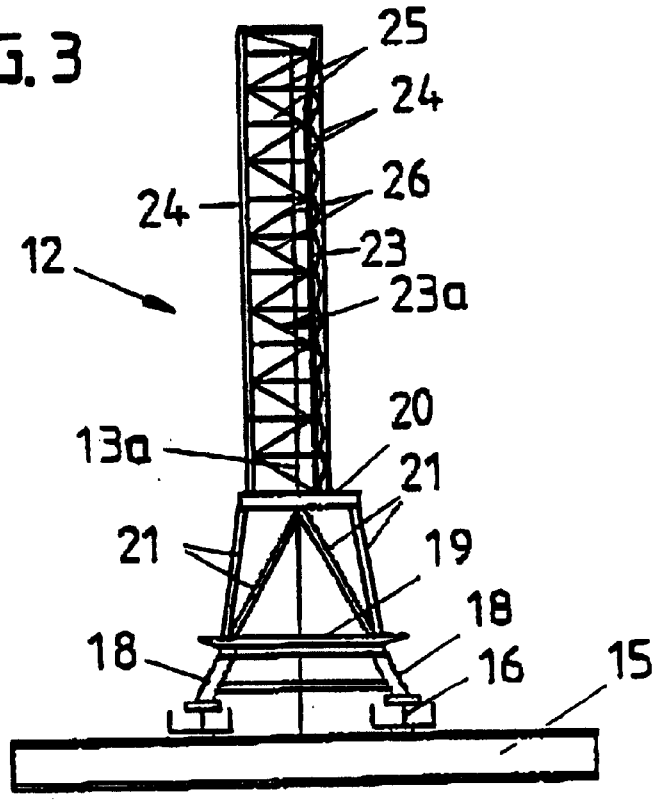

The derrick 12 has, such as shown further in FIG. 2 and 3, a lower pedestal portion 17, which is connected to the carrier rails 15 via obliquely extending support legs 18 and which comprises a first, lower working plateau 19. A second, upper working plateau 20 is supported in the lower pedestal portion 17 via obliquely extending pillars 21. To the top of the upper working plateau 20 there is fastened a rig scaffolding 23.

The rig scaffolding 23 is constructed in a manner known per se of vertical pillar pipes 24 and horizontally extending pipe pieces 25 and obliquely extending pipe pieces 26 in a rigid framework construction. The scaffolding is shown with two broad framework constructions 23*a*,23*b* on two mutually opposite scaffolding sides, two narrow framework constructions 23*c*,23*d* on the front aide of the scaffolding with a mutual intermediate space 27 between the parts 23*c*, 23*d* and a narrow framework construction 23*e* on the rear side of the scaffolding.

As is evident from FIG. 2 the side portions 23*a*′,23*b*′ extend obliquely upwards and inwards at the uppermost portion of the scaffolding. By means of the intermediate space 27 between the front portions 23*c*,23*d* a free-lying opening is defined inwardly towards the inner side of the back portion 23*a*.

In FIGS. 2 and 3 there is shown an extension 13*a* of the drill stem 13 arranged in a course centrally through the working plateau 20 at a certain distance from the back portion 23*a* of the scaffolding 23, that is to say with the scaffolding 23 localized mainly on one, left half of the pedestal portion 20 according to FIG. 3. Rear side portion 23*e* of the scaffolding 23 is consequently adapted to transfer its vertical loading relatively centrally of the pedestal portion 20 relatively closely up to the pipe line/drill stem 13, which passes centrally through the pedestal portions 19,20. Side portions 23*a*,23*b* of the scaffolding 23 extend on the other hand obliquely outwards towards their respective opposite corner of the pedestal portion 20, while the front portions 23*c*,23*d* are arranged just at each of their said opposite corners.

In FIGS. 4–7 there is shown a device 28 for installing a pipe section 29 in the scaffolding 23 and for withdrawal of a pipe section 29 (see FIGS. 5 and 6) from the scaffolding 23, that is to say respectively installing and withdrawing a series of pipe sections 29 one after the other via the opening 27. According to the invention provision is made for movements of the device to take place in a vertical plane, that is to say in one and the same plane. This involves being able to achieve a favorable constructional and operational design of the device 28, such as will be described below.

Figure 4:
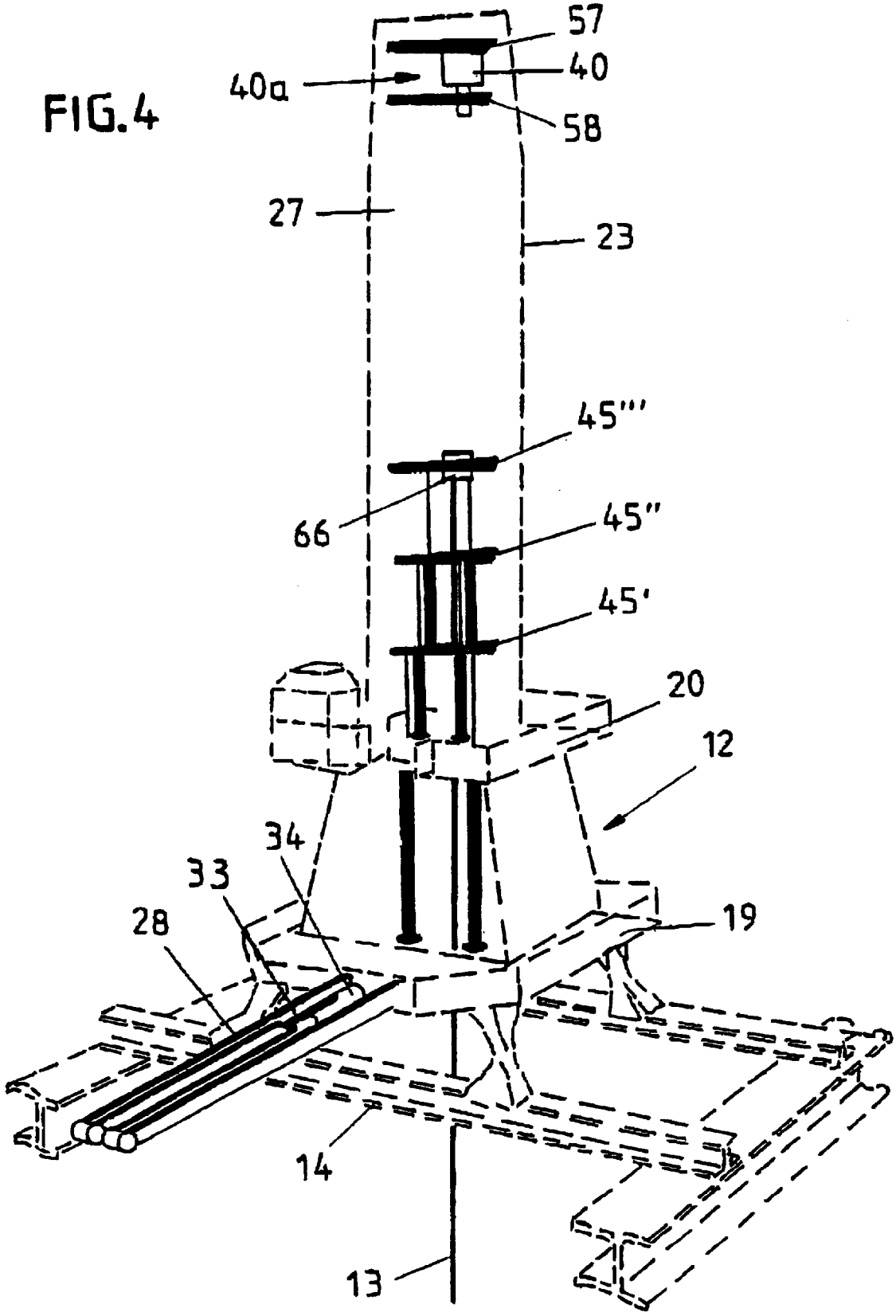
FIGS. 4–7 show the derrick in perspective with different equipment illustrated in different succeeding working positions.
Figure 5:
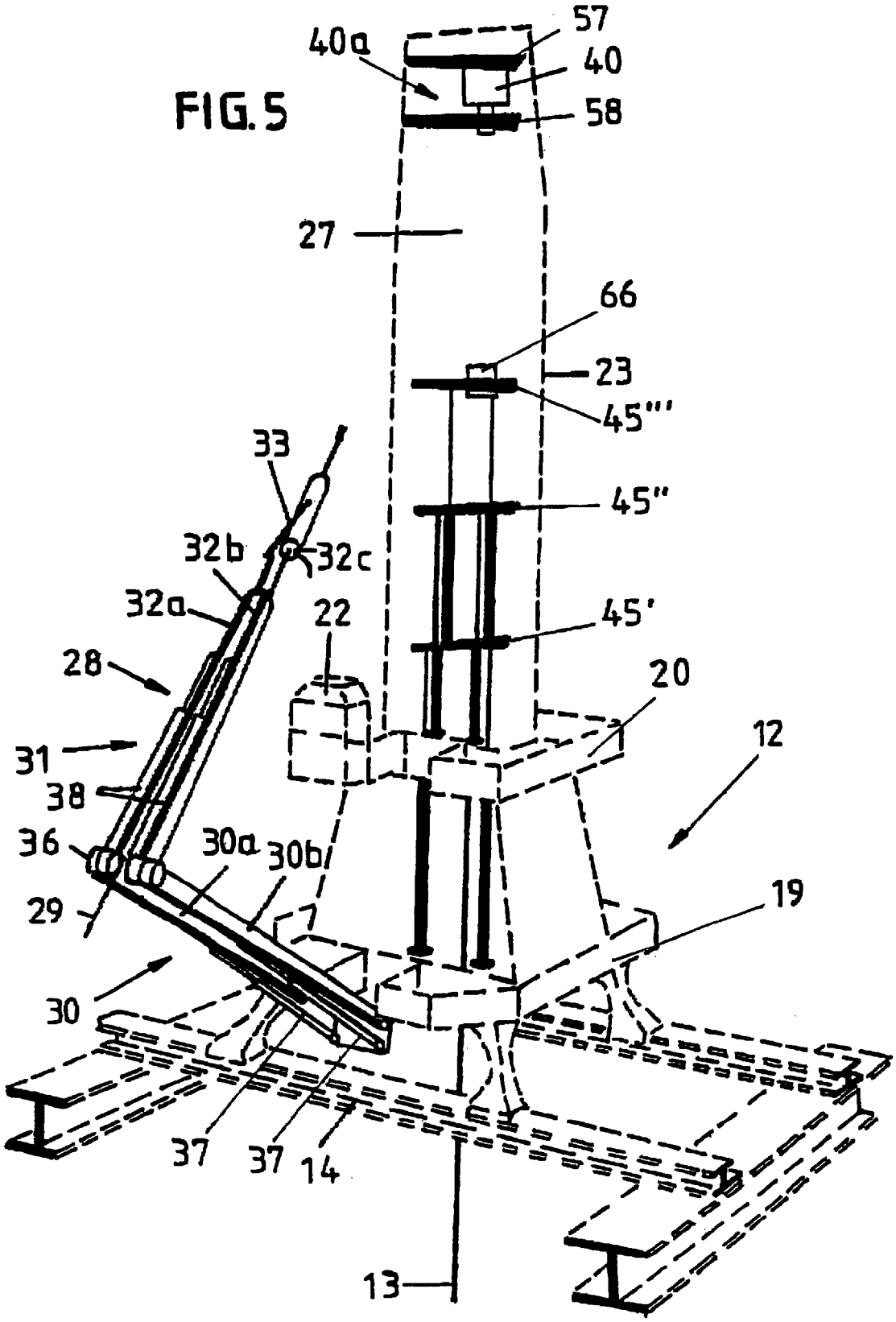
Figure 6:
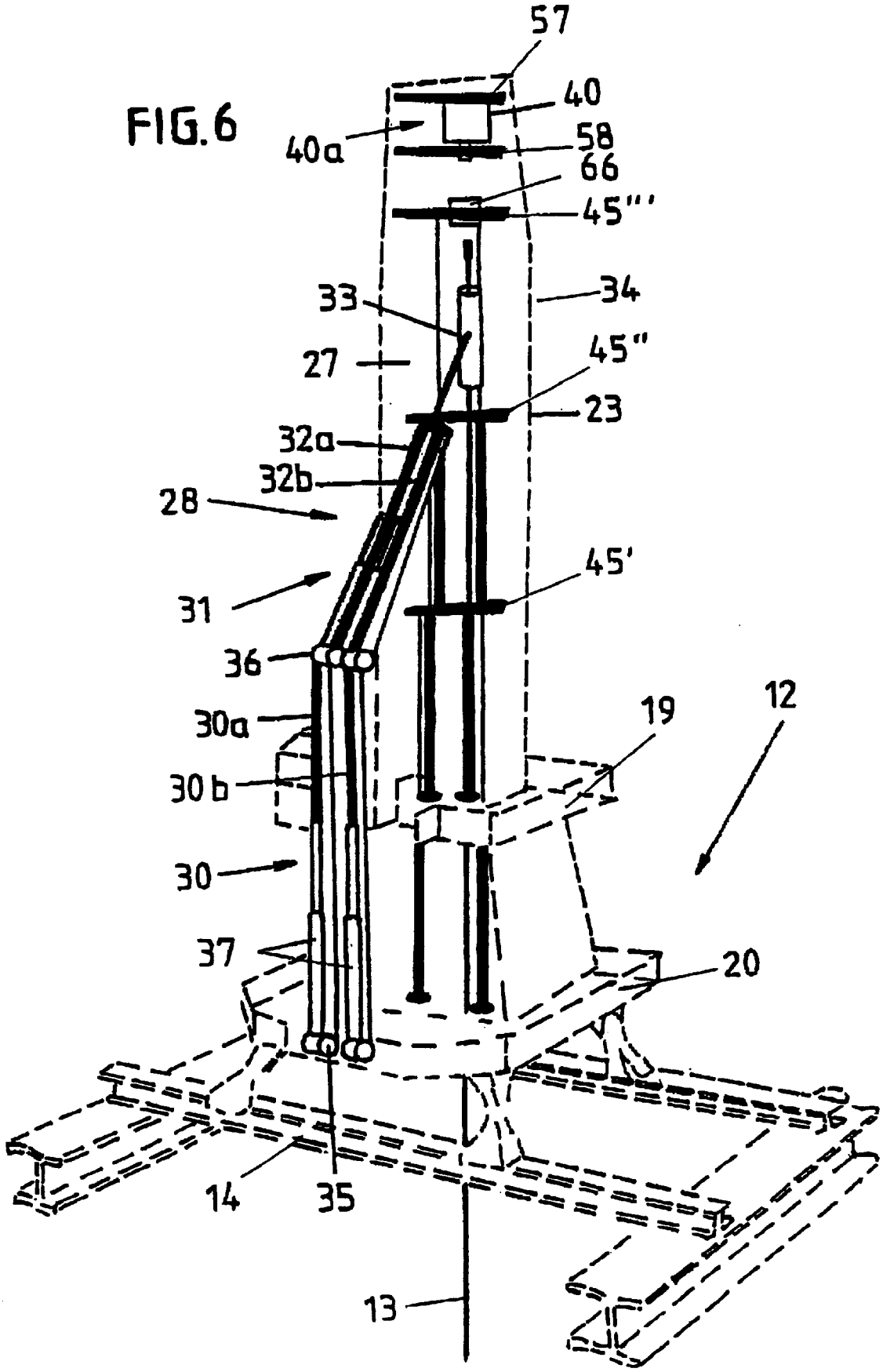
Figure 7:
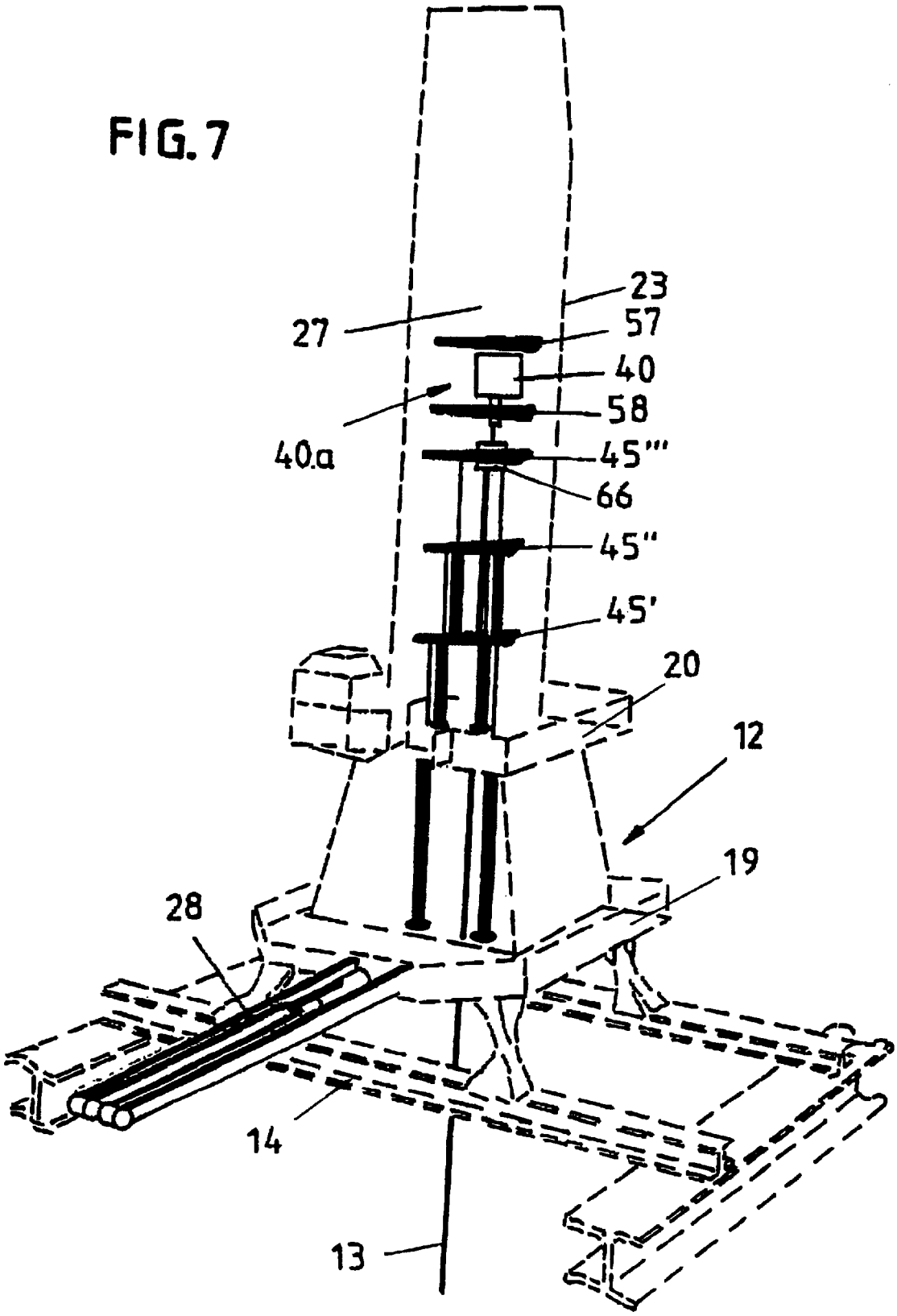

In FIG. 4 the device 28 is shown in a first position, which constitutes a pipe collecting position and in FIG. 5 in a second position, which constitutes an intermediate position or pipe transfer position, and in FIG. 6 in a third position, which constitutes a pipe delivery position. In FIG. 7 the device is shown guided back to the first position, ready for a new collecting operation.

If desired the device 28 can in the collecting position extend obliquely downwards towards a level below the derrick 12 (not shown further herein). In that the pivotal movements of the device 28 take place in one and the same plane a relatively accurate delivery of the single pipe section can be ensured in an established vertical plane through the pipe line in the derrick, that is to say in an accurate position in the scaffolding, independently of the delivery level within the scaffolding in each single case of delivery.

The device 28 comprises (see FIG. 5 and 6) a first, inner yoke 30 comprising two beams 30*a*,30*b* converging slightly outwards, having a first, relatively larger mutual distance between the beams, and a second outer yoke 31 comprising two equivalent girders 32*a*,32*b* converging slightly outwards having. a second, relatively smaller mutual distance between the beams. Outermost the girders 32*a*,32*b* are rigidly connected to each other via a beam bit 32*c*. Outermost the girder bit 32*c* is provided with a pivot bearing for pivotal mounting of a sleeve-shaped collecting and holding means 34.

The girders 30*a*,30*b* are innermost rotatably mounted on the lower working plateau 19 of the derrick in a pivot bearing 35, while innermost the girders 32*a*,32*b* are rotatably mounted in a pivot bearing 36 at the outer end of, that is to say in the intermediate apace between the girders 30*a*,30*b*. Two first pressure medium cylinders 37 are shown for swinging the girders 30*a*,30*b* relative to the working plateau 19 and two equivalent pressure medium cylinders 38 for swinging of the girders 32*a*,32*b* relative to the girders 30*a*,30*b*. A pressure medium cylinder 33 is shown for swinging of collecting and holding means 34 relative to the girder bit 32*c*. The control of the pressure medium cylinders 33,37,38 occurs. via a control housing 22 as shown on the working plateau 20. By means of separate swinging of the yokes 30,31 and the collecting and holding means 34 it is possible according to the invention to adjust the pipe section in line with the pipe line/drill stem 13 in the derrick 12 and at the same time at different height levels relative to the upper end of the pipe line/drill stem, as required, by equivalent actuation of the pressure medium cylinders 33,37,38.

Each pipe section 29 is pushed by the help of means not shown further endways inwards into and with the one end partially through collecting and holding means 34 and is clamped fast in this with separate. remotely controlled, internal clamp means (not shown further). The pushing in of the pipe section 29 in an axial direction in the collecting and holding means 34 can be regulated an required in each individual case.

During the swinging of the device 28 from the position in FIG. 4 via that in FIG. 5 over towards the position which is shown in FIG. 6 the pressure medium cylinder 33 can ensure that the collecting and holding means 34 and thereby the pipe section 29 are held in place in the intermediate space between the girders 32*a*, 32*b*. First when the device 28 is adjusted into the correct delivery or end position in the scaffolding 23 at the desired delivery level the pipe section 29 is swung by way of means 34 and the cylinder 33 to its vertical position, as is shown in FIG. 6. Further heightwise adjustment can be effected by regulating via the pressure medium cylinders 37–38. In other words the pipe section 29 can be held in place in an engagement with the means 34 in a shielded intermediate space between the girders 32*a*,32*b* during the swinging between the position as shown in FIG. 4 and the position as shown in FIGS. 7 and 8.

In FIGS. 4–7 there is shown a pipe coupling machine (top drive) 40, arranged in a separate carriage 40*a*, for turning the pipe section 29 relative to the pipe line/drill stem in connection with the joining together of these parts and for turning of the pipe line/drill stem during the boring operation. In FIGS. 4–6 the carriage 40*a* is arranged, with the machine 40 shown in an inactive position, at the upper end of the scaffolding 23, and in FIG. 7 the carriage 40*a* and the machine 40 are shown in an active position at a middle level of the scaffolding 23.

Figure 8:
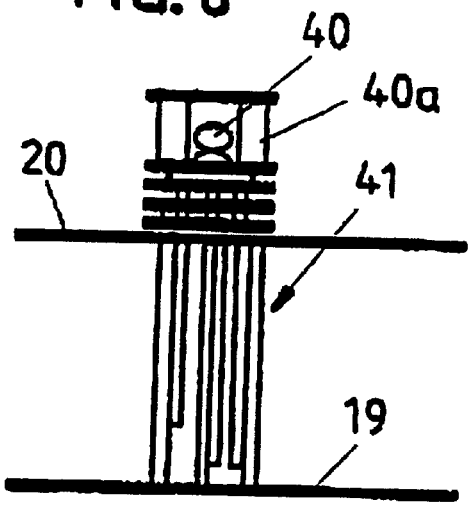
FIGS. 8–10 show in detail vertical views of a number of power means in three different working positions.
Figure 9:
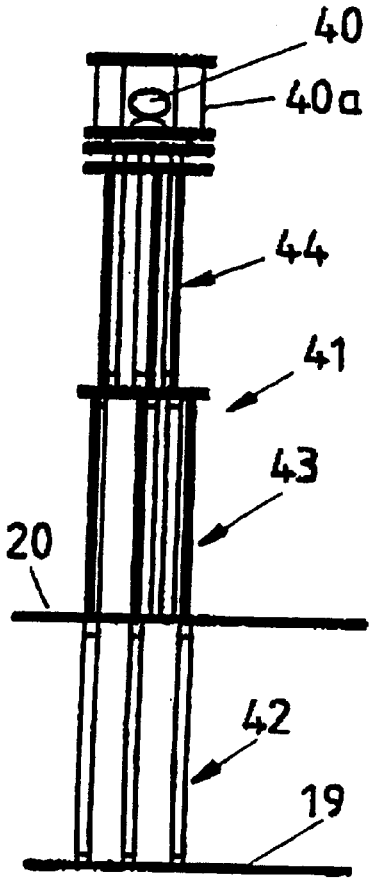
Figure 10:
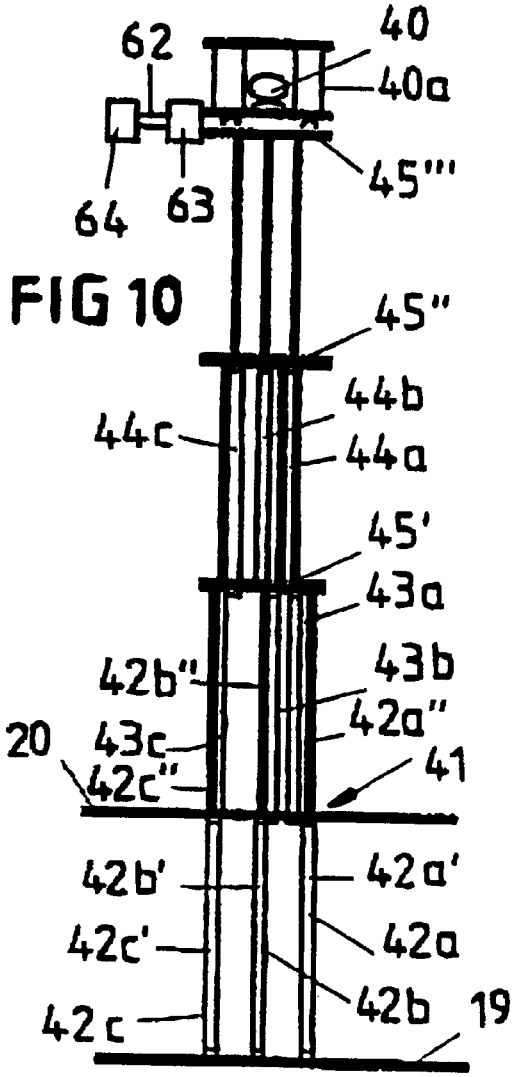

In FIGS. 8, 9 and 10 there in shown a jack aggregate 41 constructed as a number of hydraulic cylinders. Each cylinder is shown herein in the form of a pressure medium cylinder with associated piston rod. In the illustrated example each cylinder is driven with pressure oil.

The cylinders are shown in FIG. 10 arranged in three groups 42,43,44 at each of their respective levels, that is to say with the piston rods of the cylinders shown in an extended condition. In FIG. 8 the cylinders are shown in a pushed-together condition and in FIG. 9 the cylinders are shown in an intermediate position.

The cylinders in each group 42,43,44 consist of three cylinders 42*a*,42*b*,42*c*; 43*a*,43*b*,43*c* and 44*a*,44*b*,44*c*. The said three cylinders in each group are respectively placed at a mutually equal distance in the form of a triangle around an intermediate lying, middle guide (see FIGS. 11 and 12) for the pipe section 29 and the pipe line/drill stem 13. The cylinders 42*a*,42*b*,42*c* in the lowest group 42 are rigidly anchored in the derrick at opposite ends of the cylinder part via the lower working plateau 19 and the upper working plateau 20. The cylinders 43*a*,43*b*,43*c* in the most intermediate group of 43 have the cylinder part arranged axially displaced in a guide in the upper working plateau, the upper end of the cylinder part being rigidly anchored in a first, lower, rigid bridge construction or rigid bridge portion 45'. The cylinders 44*a*,44*b*,44*c* in the uppermost group 44 have the lower end of the cylinder part rigidly anchored in the first rigid bridge construction 45' and the upper end of the cylinder part rigidly anchored in a second rigid bridge construction 45". The three groups 42,43,44 have the upper end of the cylinders' 42*a*,42*b*,42*c*; 43*a*,43*b*,43*c*; 44*a*,44*b*, 44*c* associated piston rod rigidly anchored to a respective one of three bridge constructions 45',45" and 45'".

The bridge constructions 45',45",45'" are movable individually in a vertical direction internally in the scaffolding by means of their respective group 42,43,44 of cylinders. The bridge constructions 45',45",45'" are separately guided via rails 23' (see FIG. 14) in the scaffolding 23 and guide rollers 53 of the bridge constructions (see FIGS. 11–13).

It will be evident that the said three bridge constructions 45',45",45'" ensure a mutual reinforcement and shoring up of the cylinders of said three groups 42,43,44. while the bridge constructions 45',45",45'" are separately ensured lateral shoring up in the derrick/scaffolding 23 in associated rails 23' via associated guide rollers 53. In addition the aggregate 41 of cylinders is reinforced and shored up in working plateaus 19 and 20 of the derrick via the cylinder parts of the lower group 42.

A power source is employed in the form of a diesel-driven drive aggregate ("power pack") or alternatively an electrically driven drive aggregate. With the jack aggregate 41 the aim is a collective lifting capacity of for example 250 tons and a pushing force of 100 tons. A velocity for the pipe line/drill stem of 500 meters per hour is the aim at a lifting force of 250 tons and a velocity of 1000 meters per hour on guiding down of the pipe line/drill stem during exertion of a downwardly directed compressive force of 100 tons An actual lifting height in the drill rig is 15 meters, designed for handling pipe sections in lengths of 9.5 and 13.5 meters.

Figure 11:
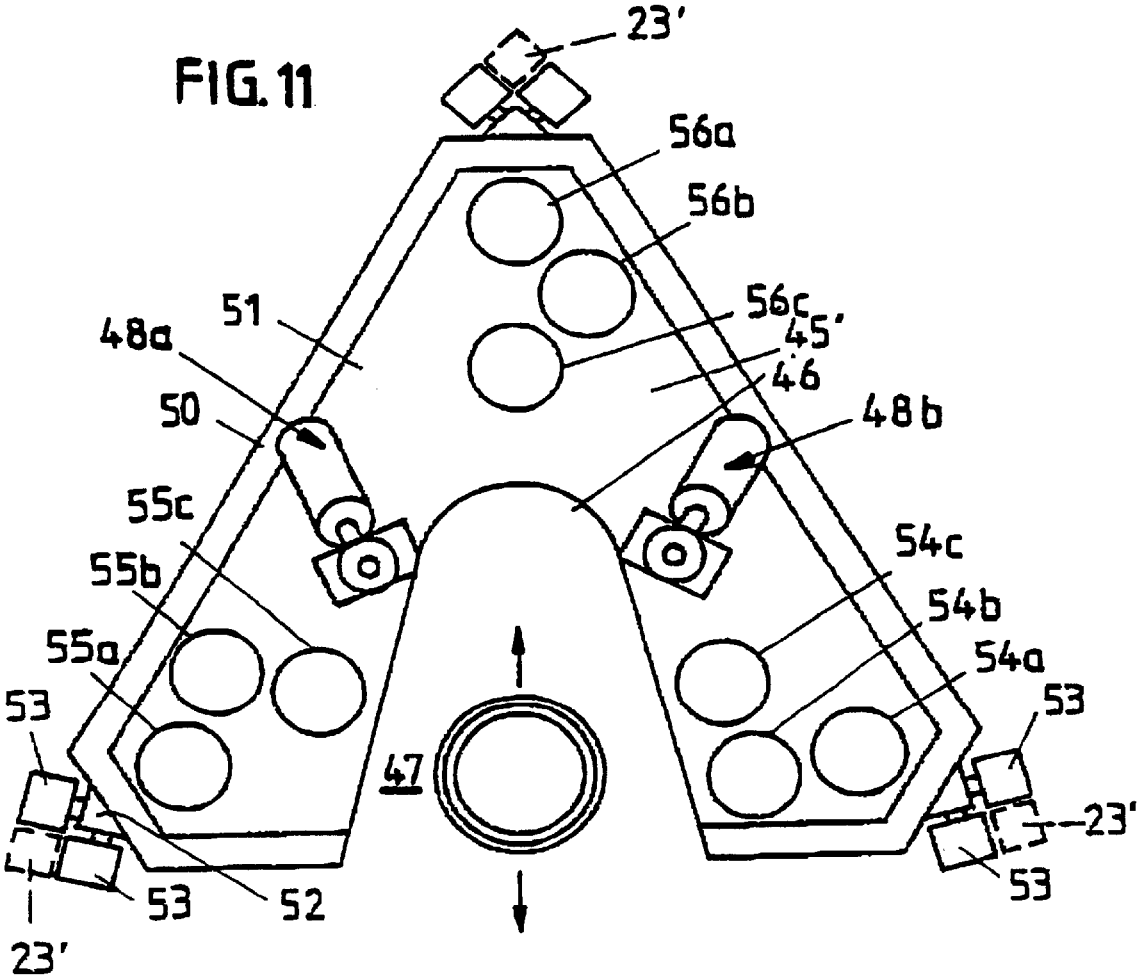
FIGS. 11 and 12 show in a plan view a bridge portion or a bridge construction with stop-/support means shown in two different positions.
Figure 12:
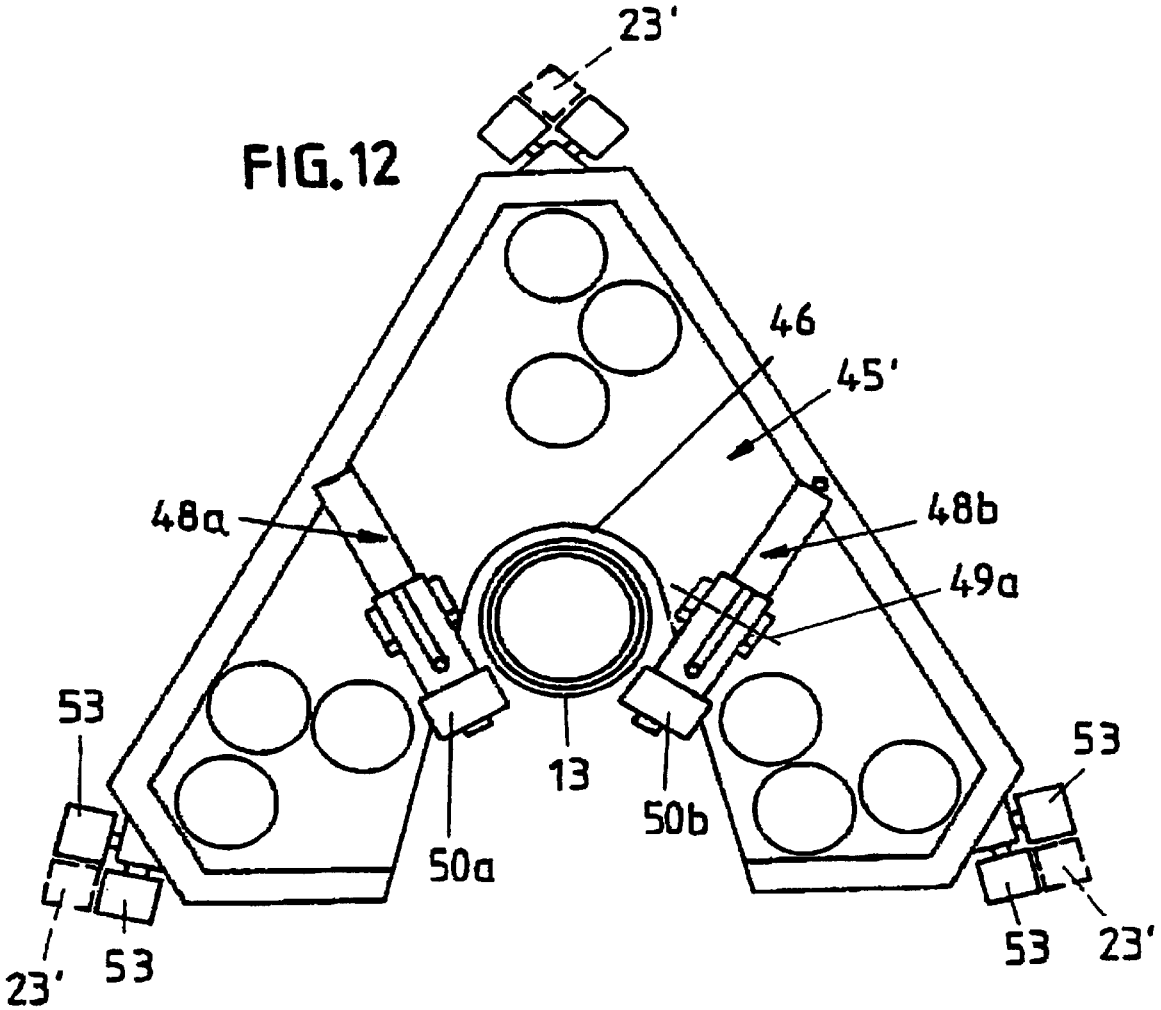

In FIGS. 11 and 12 there is illustrated a roughly triangular bridge construction 45' having a significant recess 46 for the reception of a pipe section 29 and a pipe line/drill bit centrally in the bridge construction. The recess 46 has an opening 47 which empties freely outwards on one side of the bridge construction, so that a pipe section can in a freely movable manner be installed sideways or withdrawn sideways from the recess 46, as is shown in the position in FIG. 11. Thereafter the pipe sections can be joined together one after the other with the pipe line/drill stem 13. Finally the pipe line/drill stem having the pipe line jointed for this be closed off, as in shown in FIG. 12. by hydraulically or electrically driven stop means 48*a*,48*b*, which are pivotally mounted on a respective side of the opening 47 in their respective pivot bearings 49, which are adapted to the stop means 48*a*,48*b* about a horizontal axis 49*a*. The stop means are illustrated with their respective guide rollers 50*a*,50*b*.

Figure 14:
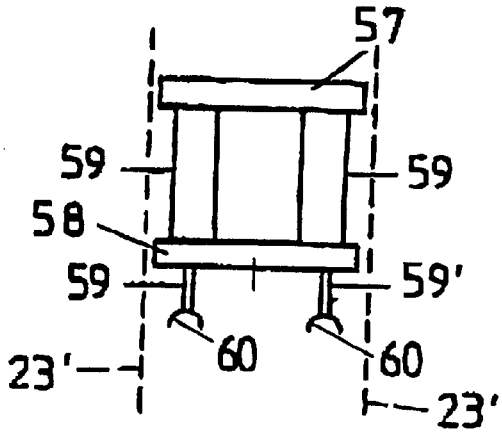
FIG. 14 shows a side view of the pipe coupling machine and associated carriage.
Figure 13:
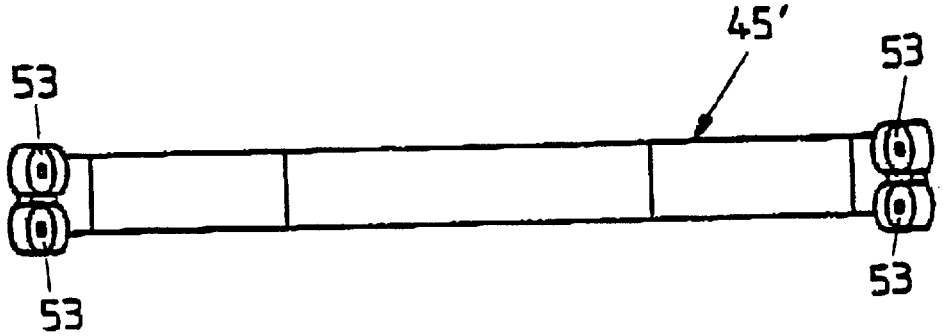
FIG. 13 shows a bridge construction seen in a side direction.

The bridge construction 45' comprises an approximately V-shaped framework 51*a*, which surrounds an approximately V-shaped plate construction 51*b*. To each triangular corner of the bridge construction there is fastened a fitting 52 having two pairs of support wheels 53, such as is shown in FIGS. 11–13 for the support of the bridge construction laterally in three rails 23' as indicated in FIG. 14. In the plate construction 51*b* of the bridge construction 45' there are formed three groups of circular recesses 54*a*,55*a*,56*a*; 54*b*, 55*b*,56*b* and 54*c*,55*c*,56*c*, which cooperate with their respective power means of a respective one of the three groups of power means 42,43,44. cylinders of the first group 42 are arranged in the three outermost lying recesses 54*a*,55*a*,56*a*, while cylinders of the second group 43 are arranged in the three most central recesses 54*b*,55*b*,56*b* and cylinders of the third group 44 are arranged in the three innermost recesses 54*c*,55*c*,56*c*. The aim is to arrange the cylinders sideways relatively closely up to each other, but at the same time with a gradually smaller distance between the cylinders in each group heightwise in the aggregate 41. In the two uppermost bridge constructions 45" and 45'" there is only a need for fastening respectively two and one group(s) of cylinders, that is to say collectively six and three power means respectively, while the bridge constructions can otherwise be of like design.

The aggregate 41 of cylinders is supported, as shown in FIGS. 4–7 and FIGS. 8–10 below in two working plateaus 19,20 and above by the bridge constructions 45'–45'", which in turn are supported laterally in the scaffolding 23 via rails 23' as shown in FIGS. 14. There is ensured hereby an effective support partly in the working plateaus 19,20 and partly in the scaffolding 23.

The pipe coupling machine 40 is mounted in a carriage 40*a*, which is movable on rail-forming tubular portions in the scaffolding 23, such as shown in broken lines 23' in FIG. 14, that is to say the same rails which are employed for the guide rollers 53 for the bridge constructions 45', 45",45'". The carriage 40*a* is, as shown in FIG. 14, equipped with an upper bridge construction 57 and a lower bridge construction 58, which can have equivalent constructional structures as the bridge construction 45' as shown in FIGS. 11–13. The bridge constructions 57,58 are held vertically separated via four pillars 59. In the illustrated embodiment the pillars 59 are made up of the cylinder part of four pressure medium cylinders, while piston rods 59' of the pressure medium cylinders are adapted to be displaced vertically downwards from and upwards towards the bridge construction 58.

The piston rods 59' are lowermost equipped with first coupling means 60, which are adapted to be coupled together with equivalent second coupling means 61 (see FIG. 14), which are fastened to the third, that is to say the uppermost bridge construction 45'" in the aggregate 41.

The objective according to the invention is to park the carriage 40*a* in the upper end of the derrick by releasing the coupling means 60,61 between the carriage 40*a* and the bridge construction 45'" in the aggregate 41. This is carried out in that the carriage 40*a* is first lifted via the aggregate 41 to the actual parking position in the derrick 23. Thereafter a set of gripping and holding means 62 (of which only one is shown in FIG. 14), which is fastened to the scaffolding 23 and which grips physically in with equivalent stop 63 of the carriage for securing the latter relative to the scaffolding 23. Thereafter the actuating means 64 is activated, which releases the coupling means 60 of the carriage 40*a* from equivalent coupling means 61 of the bridge construction 45'".

According to the invention the carriage 40*a* can be held inactive during the installation of the pipe section 29 in the derrick 12 and during the withdrawal of the pipe section 29 from the derrick 12. Consequently unnecessary movement of the carriage 40*a* with accessories can be prevented during the installation procedure and the withdrawal procedure or during portions of this procedure, for example on movements in or closely up to the derrick.

When the carriage 40*a* is to collect the aggregate 41 again coupling means 60 of the carriage is landed on coupling means 61 of the bridge construction and activates a coupling together of these, after which the engagement between the gripping and holding means 63 of the carriage 40*a* and the gripping and holding means 62 in the scaffolding 23 is lifted.

The activation/release of the gripping and holding means 62 relative to their stop 63 and the activation/release of the coupling means GO of the carriage 40*a* relative to the coupling means in the bridge construction 45'" can if desired be automatically controlled relative to each other or be effected by separate remote control, in a manner not shown further.

An advantage according to the invention is that the carriage 40*a* with associated equipment can be separately parked, so that the carriage 40*a* and associated drive medium conduits, and the like, do not need to participate in all movements which the aggregate must be subjected to during use. At the same time the possibility exists of being able to effect the coupling and the uncoupling between pipe section and pipe line/drill stem and between pipe section 29 and pipe coupling machine separately. This is carried out in that the pipe section 29 is retained in the gripping and holding means 34 of the pipe collecting device 28 at the same time as one end of the pipe section 29 is retained in either the pipe line/drill stem or in a pipe coupling machine ("roughneck") 65.

The pipe section 29 is coupled at its upper end to the pipe coupling machine 65 in the carriage 40*a* via a gripping and holding means ("slips") 66 in the upper bridge construction 45'". The lower end of the pipe section is coupled to the pipe line/drill stem via a gripping and holding means ("slips") 67 on the upper working plateau. The pipe line/drill stem 13 is held during the whole coupling and uncoupling procedure in a lower gripping and holding means ("slips") 66 on the lower working plateau 19.

What is claimed is:

1. Derrick (12), comprising A number of hydraulic cylinders (42*a*,42*b*,42*c*) arranged in groups (42) having pistons and associated extendible piston rods for axial movement of a drill stem (13) in the derrick (12), where the piston rods at their upper ends are mutually rigidly connected to each other by a bridge portion (45'), characterised in that the derrick (12), in addition to the first-mentioned group (42) of hydraulic cylinders (42*a*,42*b*,42*c*), comprises additional groups (43,44) of hydraulic cylinders (43*a*, 43*b*,43*c*44*a*,44*b*,44*c*) arranged over each other having respective piston rods connected in upper bridge portions (45',45", 45'"), each group (43,44) of the above standing cylinders (43*a*, 43*b*,43*c*; 44*a*,44*b*,44*c*) being carried by the bridge portion of the group standing below;

that each group (42,43,44) of cylinders (42*a*,42*b*,42*c*;43*a*, 43*b*,43*c*; 44*a*,44*b*,44*c*) is arranged around a middle space for the drill stem (13), and the derrick carries arrangements (40) for rotation of the drill-stem (13), said arrangements (40) being releasably fixed to the bridge portion (45'") for the uppermost group of pistons (44*a*–44*c*).

2. Derrick in accordance with claim 1, characterised in that the cylinders (42*a*–42*c*,43*a*–43*c*,44*a*–44*c*) in each group (42,43,44) are arranged in the form of a triangle equally spaced relative to each other.

3. Derrick in accordance with claim 2, characterised in that the cylinders (44*a*–44*c*) in the uppermost group (44) have the least mutual spacing, and that the cylinders (42*a*–42*c*) in the lowermost group (42) have the largest mutual spacing.

4. Derrick in accordance with claim 1, characterised in that each bridge portion (45', 45", 45'") is shored up and reinforced via guide rails in the derrick (12) and via guide means, such as guide rollers (53), in the bridge portion (45', 45", 45'").

5. Derrick in accordance with claim 1, characterised in that the bridge portion or each bridge portion (45', 45", 45'"), in addition to the fastening for the one end of the piston rods of cylinders (42*a*–42*c*, 43*a*–43*c*,44*a*–44*c*) of the associated group (42, 43, 44), forms a fastening for cylinders of an above standing group (42–43, 43–44) and forms a guide for piston rods of an additional group which pass through the bridge portion (45', 45").

6. Derrick in accordance with claim 1, characterised in that each bridge portion (45', 45", 45'") is equipped with a laterally opening recess (46) for sideways installation and sideways withdrawal of a section (29) of the drill stem (13) in the space between the group (42, 43, 44) of cylinders (42*a*–42*c*, 43*a*–43*c*,44*a*–44*c*), and that the recess (46) is closeable with stop means for closing off a section (29) of the drill stem (13) having side support in a guide in the recess (46).

7. Derrick in accordance with claim 1, characterised in that the arrangements (40) for rotation of the drill stem (13) are arranged in a separate carriage (40*a*), which is designed for separate handling of a drill stem section (29) relative to the remaining drill stem (13), the carriage (40*a*) being in a first position releasably fixed to the bridge portion (45'") for an uppermost group (44) of piston rods of cylinders (44*a*–44*c*), while the carriage (40*a*) in a second position is separately parkable at a distance from said bridge portion (45'").

* * * * *